US010907291B2

(12) United States Patent
Chai

(10) Patent No.: US 10,907,291 B2
(45) Date of Patent: Feb. 2, 2021

(54) LAUNDRY APPLIANCE AND OPERATING METHOD

(71) Applicant: Fisher & Paykel Appliances Limited, Auckland (NZ)

(72) Inventor: Shan Chai, Auckland (NZ)

(73) Assignee: FISHER & PAYKEL APPLIANCES LIMITED

( * ) Notice: Subject to any disclaimer, the term of this patent is extended or adjusted under 35 U.S.C. 154(b) by 103 days.

(21) Appl. No.: 16/163,001

(22) Filed: Oct. 17, 2018

(65) Prior Publication Data

US 2019/0112745 A1 Apr. 18, 2019

(30) Foreign Application Priority Data

Oct. 17, 2017 (NZ) ..... 736459

(51) Int. Cl.
*D06F 37/20* (2006.01)
*D06F 37/30* (2020.01)
(Continued)

(52) U.S. Cl.
CPC ..... *D06F 37/203* (2013.01); *D06F 34/18* (2020.02); *D06F 34/28* (2020.02); *D06F 37/302* (2013.01);
(Continued)

(58) Field of Classification Search
CPC ..... D06F 33/48; D06F 33/76; D06F 24/08; D06F 24/16; D06F 2103/26;
(Continued)

(56) References Cited

U.S. PATENT DOCUMENTS 2,990,706 A 7/1961 Bochan
7,446,500 B2 11/2008 Schulze et al.
(Continued)

FOREIGN PATENT DOCUMENTS

DE 2416518 10/1975
DE 19947307 11/2000
(Continued)

OTHER PUBLICATIONS

Extended European Search Report dated Feb. 22, 2019 for EP App. No. 18200348.3.

*Primary Examiner* — Michael E Barr
*Assistant Examiner* — Omair Chaudhri
(74) *Attorney, Agent, or Firm* — Clark Hill PLC; James R. Foley

(57) ABSTRACT

A method of operating a laundry washing (or washing and drying) machine, and a machine so operated, for determining whether an undetached laundry ring is present within the drum at the end of a washing cycle. The method includes rotating the drum at first and second rotational speeds, respectively below and above the threshold speed at which the load is centrifugally held against the drum's surface, measuring motor current/torque at each speed and comparing the measured values. Optionally, a percentage change in current/torque can be calculated and the existence of the ring detected if the percentage change is above/below a predetermined threshold value. Optionally, speed variation of the drum at each threshold speed can be determined and this information also used in the determination of whether the ring exists.

18 Claims, 7 Drawing Sheets

Figure 1:
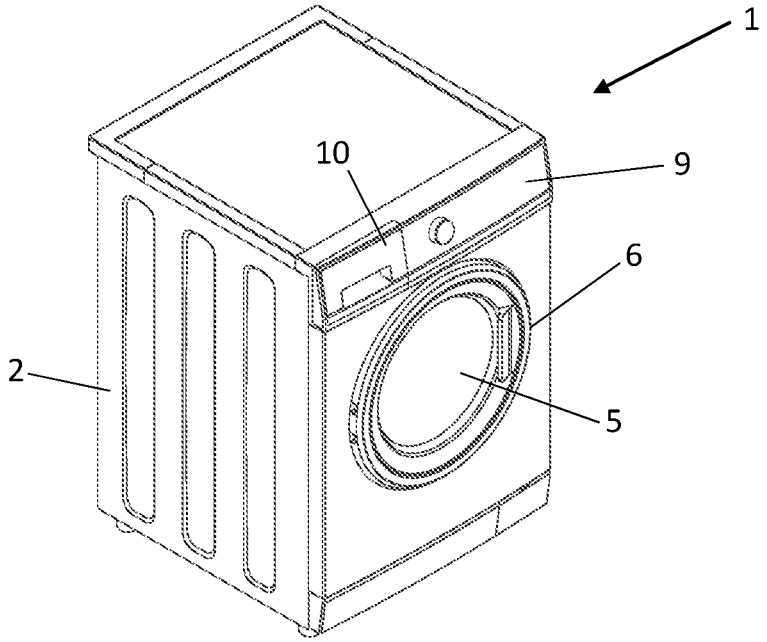

(51) Int. Cl.

| | |
|---|---|
| ***D06F 37/36*** | (2006.01) |
| ***D06F 34/18*** | (2020.01) |
| ***D06F 33/00*** | (2020.01) |
| ***D06F 34/28*** | (2020.01) |
| *D06F 35/00* | (2006.01) |

(52) U.S. Cl.
CPC ..... *D06F 37/304* (2013.01); *D06F 37/36* (2013.01); *D06F 33/00* (2013.01); *D06F 35/007* (2013.01); *D06F 2202/10* (2013.01); *D06F 2202/12* (2013.01); *D06F 2204/065* (2013.01); *D06F 2212/02* (2013.01); *D06F 2222/00* (2013.01)

(58) Field of Classification Search
CPC ..... D06F 2103/46; D06F 33/50–76; D06F 37/203; D06F 34/00; D06F 34/08; D06F 34/14–18; D06F 35/005; D06F 35/007; D06F 37/04; D06F 37/36; D06F 33/00–76
See application file for complete search history.

(56) References Cited

U.S. PATENT DOCUMENTS

| | | | | |
|---|---|---|---|---|
| 2006/0125428 | A1* | 6/2006 | Schulze | D06F 35/007 318/53 |
| 2007/0039106 | A1 | 2/2007 | Stansel et al. | |
| 2008/0289118 | A1* | 11/2008 | Park | D06F 37/203 8/159 |
| 2011/0067186 | A1* | 3/2011 | Johansson | D06F 35/006 8/137 |
| 2013/0152312 | A1* | 6/2013 | Janke | D06F 33/00 8/137 |
| 2013/0160219 | A1* | 6/2013 | Ashrafzadeh | D06F 35/007 8/137 |
| 2018/0100260 | A1* | 4/2018 | Jang | D06F 34/18 |

FOREIGN PATENT DOCUMENTS

| | | |
|---|---|---|
| DE | 1034415 | 12/2004 |
| DE | 10344158 | 12/2004 |
| EP | 2607537 | 6/2013 |
| EP | 2684990 | 1/2014 |

* cited by examiner

LAUNDRY APPLIANCE AND OPERATING METHOD

This application claims the benefit of NZ Application No. 736459, filed Oct. 17, 2017, the contents of which is incorporated herein in its entirety.

This invention relates to a laundry appliance and its method of operation and in particular, though not solely, to a method of detecting the presence or absence of an undetached "laundry ring" in the drum of a laundry washing machine.

Usually, the final phase in the wash cycle of a laundry washing machine is a high speed, centrifugal water-extracting drum rotation (or "spin"). The rotational speed of the drum during the high speed spin may be greater than 1000 rpm, for example 1400 rpm. The speed and duration of the high speed spin are set in order to ensure that an acceptably low residual moisture level of the load is achieved. During the high speed spin, the laundry/clothes load is spread over the drum's inner surface around its circumference and compressed there-against with portions of the load engaging with the drum perforations (i.e., drum holes). For some laundry or fabric types, such as towels, this compression and perforation engagement results in the load "sticking" or adhering to the inner surface of the drum, requiring a user or operator of the machine to peel the load from the drum to enable subsequent unloading. When this phenomenon occurs, the load is often said to have formed an undetached (or attached) "laundry ring". In the case of a combined laundry washing and drying appliance (or "washer/drier"), which is ordinarily a front-loading machine, the existence of a laundry ring at the end of the washing cycle has a detrimental effect on the performance of a subsequent drying operation as the load is unable to tumble through the heated air.

In the case of a front-loading (or "horizontal axis") laundry machine, the adhesive force of the load to the drum in some situations is sufficient, when the drum is subsequently stationary, to resist the weight of the load such that even the fabric at the top of the drum (that is, furthest from the floor on which the machine is located) does not drop to the bottom of the drum under its own weight. The strength of the adhesion/bond between the load and the drum is dependent upon the duration and speed of the final spin and is often strong enough to persist through subsequent conventional drum movements (that is, involving normal rotational speeds and reversals of rotation direction that would occur in a conventional washing cycle). In order to detach a laundry ring from the drum's surface it is known to operate the drum in a manner to loosen or shake the load free from the drum's surface, such as by rapidly changing speed and/or rotational direction of the drum until the laundry ring is broken (see, for example, DE19947307C). It is also known to introduce water to the load in order to assist with detaching the load from the drum's surface, as disclosed for example in U.S. Pat. No. 2,990,706A and DE2416518A. Interestingly, once a laundry ring has been broken/detached, subsequent high-speed spinning will not ordinarily result in re-formation of an undetached laundry ring.

Previously, as in the aforementioned U.S. Pat. No. 2,990,706A and DE2416518A, instead of detecting the existence of a laundry ring, it is known to simply assume that the ring exists and to carry out laundry ring loosening steps irrespective of whether the laundry ring is known to be present. This is of course inefficient in terms of time and energy/water consumption, may unnecessarily stress the machine and its components and may unnecessarily produce noise and vibrations. A further prior example of this type of machine (that assumes the existence of a laundry ring and then proceeds to dislodge it) is disclosed in U.S. Pat. No. 7,446,500B wherein, prior to washing commencing, a learning phase is conducted in which one or more state variables are measured, at two different rotational drum speeds, providing data representative of both an attached laundry ring and loosened/disentangled laundry. Then, following completion of the washing cycle an anti-crease operation commences, the first phase of which is a laundry loosening stage wherein the drum is driven with short and strong accelerating or braking pulses which continue until it is determined that a laundry ring no longer exists. Detachment of a laundry ring is detected by comparing the one or more measured state variables to the values previously obtained and then, once it is determined that no ring exists, regular periodic constant speed rotations in alternate rotational directions ensue to avoid creasing. While such a system may be able to detect detachment of a laundry ring formed by a reasonably large/heavy laundry load, it may struggle to detect detachment of a light laundry load, and it relies on carrying out a time-consuming learning phase at the beginning of each washing cycle.

It would therefore be desirable to be able to detect the presence or absence of a laundry ring, for all potential load sizes/masses, in a manner that does not significantly lengthen the washer's cycle, and only carry out laundry ring loosening/breaking operations if the ring is determined to be present.

It is therefore an object of the present invention to provide a method of operating a laundry washing machine, and a laundry washing machine so programmed, that will overcome at least some of the above disadvantages or which will at least provide the public with a useful choice.

In a first aspect, the invention consists in a method of deciding whether an undetached laundry ring is present in the drum of a laundry washing machine or washing and drying machine following a spinning operation of a laundry load, the drum rotationally driven by an electric motor, the method comprising the steps of:

- energising the motor to rotate the drum at a first rotational speed,
- determining an indication of the magnitude of the motor current at the first rotational speed,
- energising the motor to rotate the drum at a second rotational speed, different to the first rotational speed,
- determining an indication of the magnitude of the motor current at the second rotational speed, and
- deciding whether an undetached laundry ring is present in the drum by comparing the motor current magnitude indication at the first rotational speed to the motor current magnitude indication at the second rotational speed.

In a second aspect, the invention consists in a method of operating a laundry washing or washing and drying machine having a drum for receiving a laundry load, the drum rotated by an electric motor, the method comprising the steps of:

- carrying out a washing cycle including a centrifugal spin-drying phase, and subsequent to the centrifugal spin-drying phase, carrying out the method according to the first aspect to decide whether an undetached laundry ring is present in the drum.

In a third aspect, the invention consists in a laundry washing or washing and drying machine comprising:

- a cabinet,
- a water container mounted within the cabinet, a drum supported within the water container and rotatable relative thereto, the drum adapted to hold a laundry load, an electric motor having a rotor connected for rotating the drum when energised to do so, a current sensor to provide an indication of the motor current, and a controller operable to energise the rotor to rotate the drum at selected rotational speeds and to receive the motor current indication from the current sensor, the controller configured to:

energise the motor to rotate the drum at a first rotational speed, determine the magnitude of the motor current indication at the first rotational speed, energise the motor to rotate the drum at a second rotational speed, different to the first rotational speed, determine the magnitude of the motor current indication at the second rotational speed, and decide whether an undetached laundry ring is present in the drum by comparing the motor current magnitude indication at the first rotational speed to the motor current magnitude indication at the second rotational speed.

This invention may also broadly be said to consist in the parts, elements and features referred to or indicated in the specification of the application, individually or collectively, and any or all combinations of any two or more said parts, elements or features, and where specific integers are mentioned herein which have known equivalents in the art to which this invention relates, such known equivalents are deemed to be incorporated herein as if individually set forth.

The invention consists in the foregoing and also envisages constructions of which the following gives examples only. It should be appreciated that, although the invention has particular benefits in a combined laundry washing and drying appliance, there are also advantages in incorporating the present invention in a laundry washing appliance (either front- or top-loading) that does not carry out a drying cycle, by efficiently determining when it is necessary to detach a laundry ring. Once it has been determined that an undetached laundry ring is present in the drum, this information may be presented to a user or the machine may be operated to automatically attempt to dislodge the laundry ring.

Figure 2:
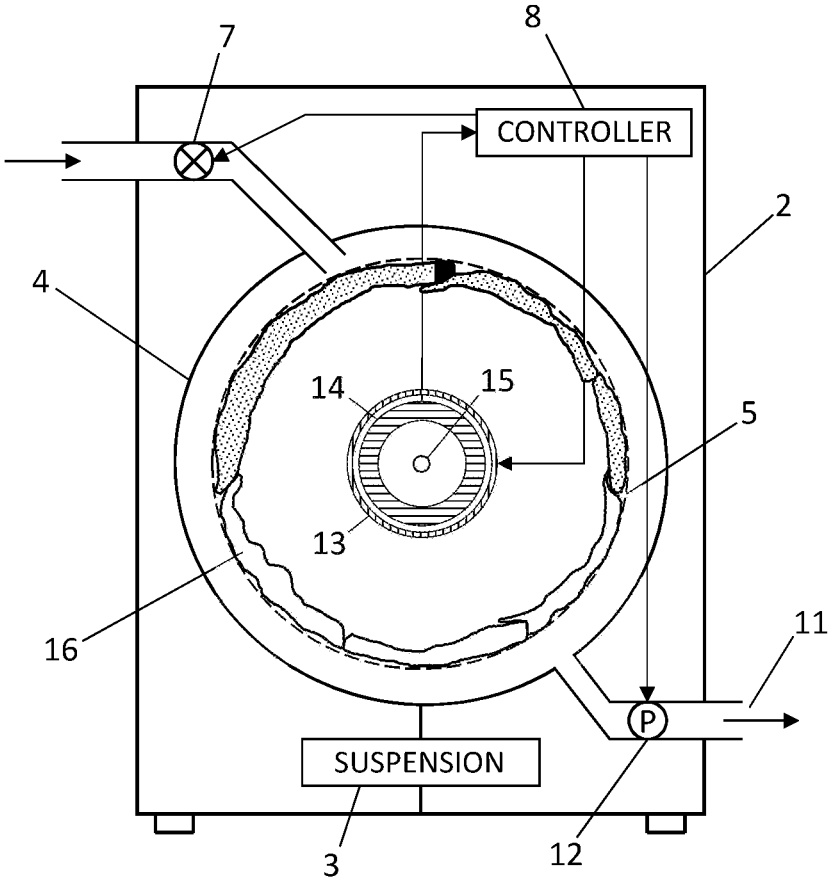
Figure 3:
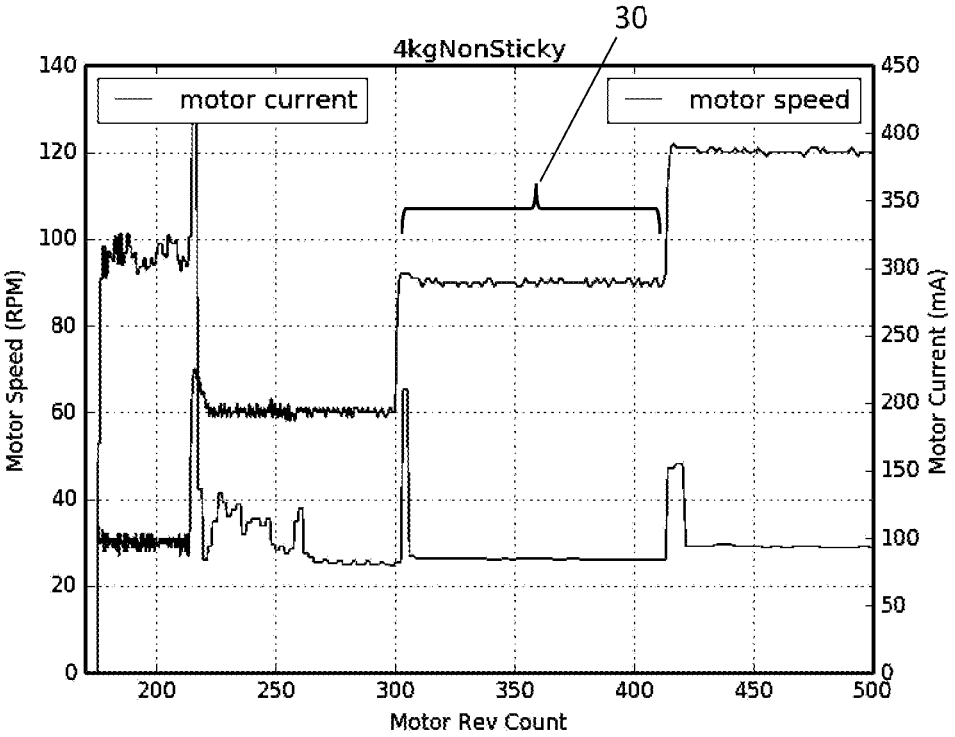
Figure 4:
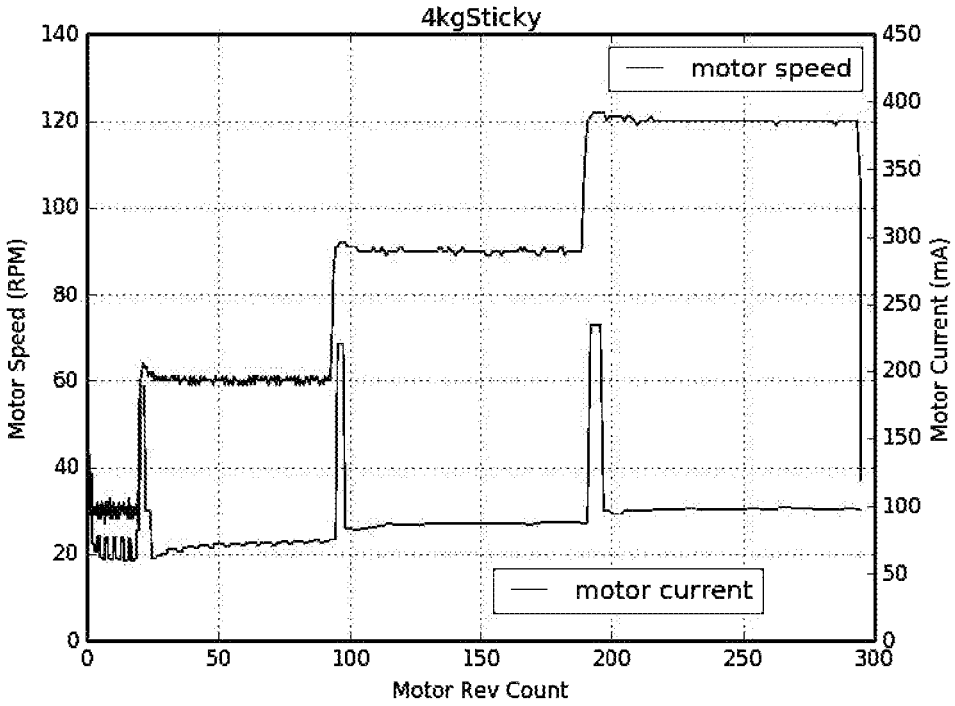
Figure 5:
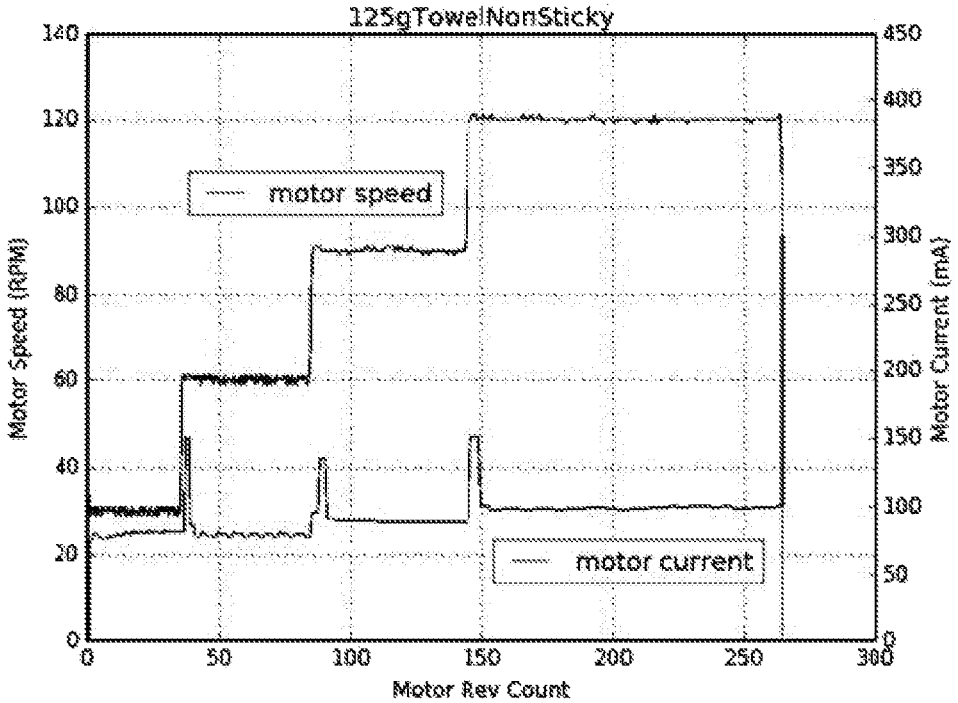
Figure 6:
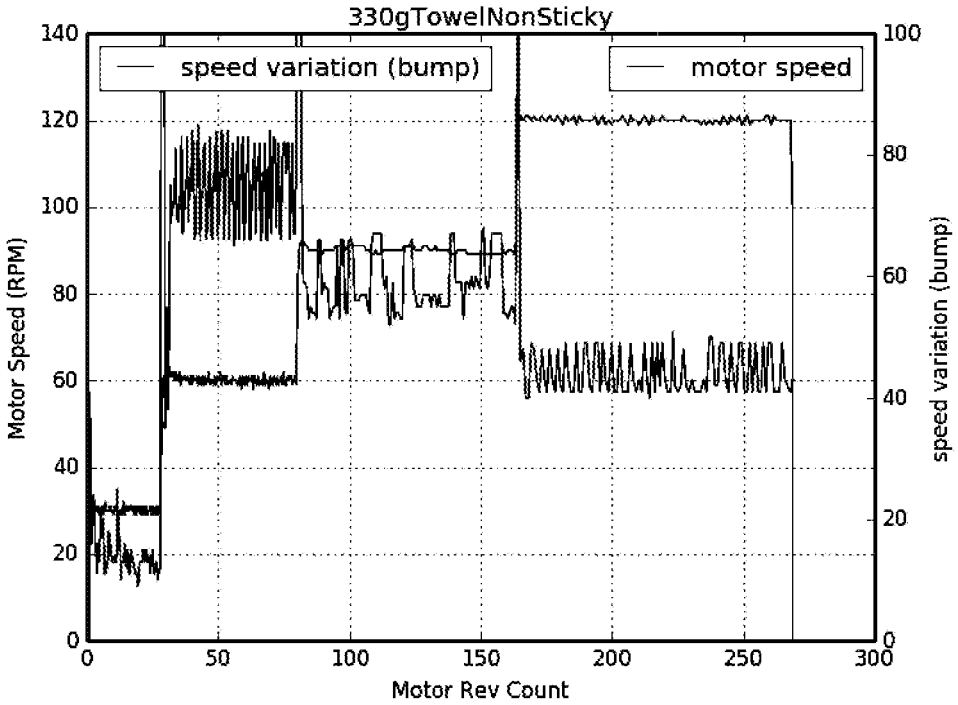
Figure 7:
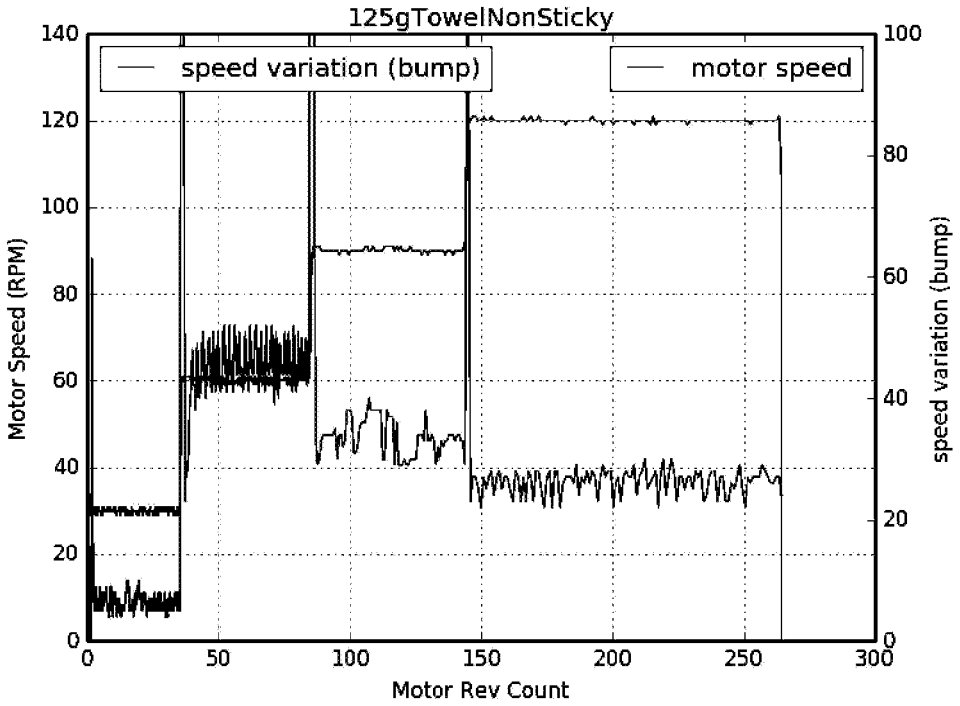
Figure 8:
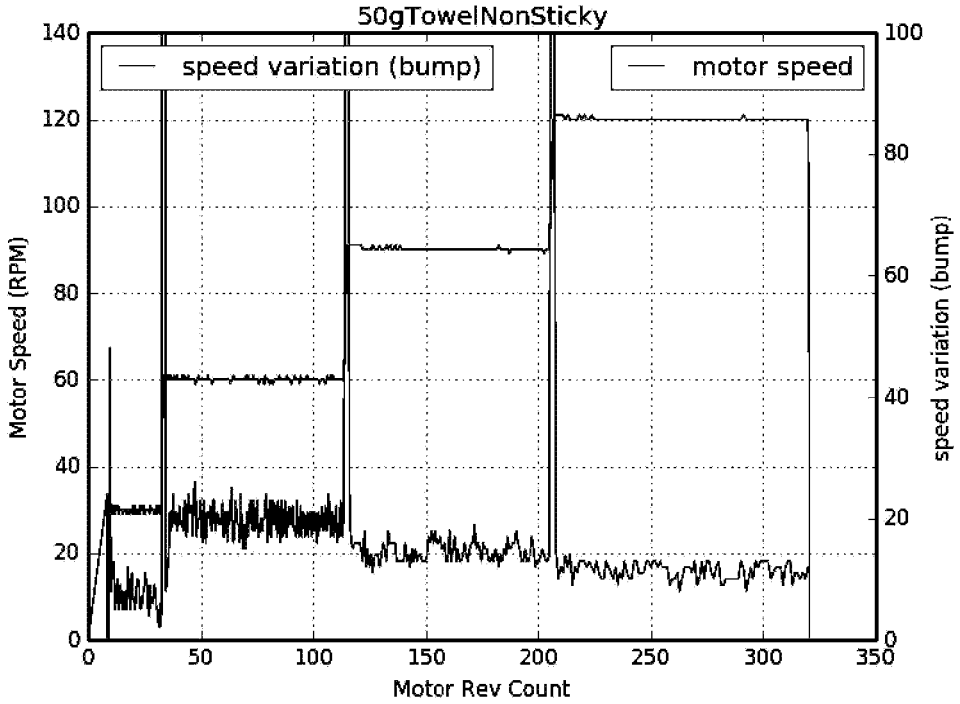
Figure 9:
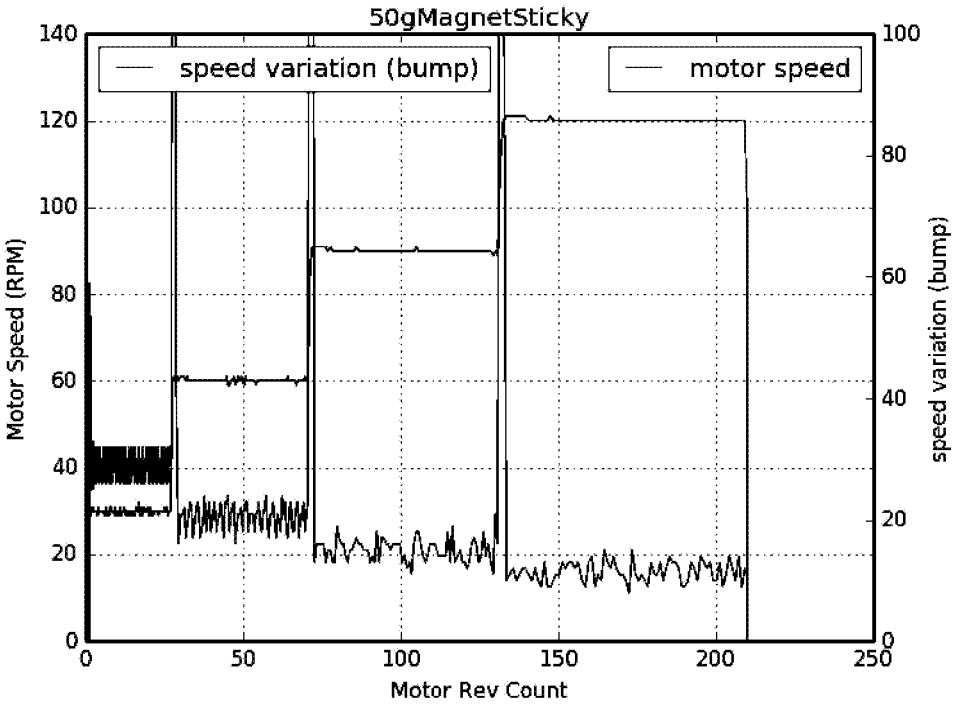
Figure 10:
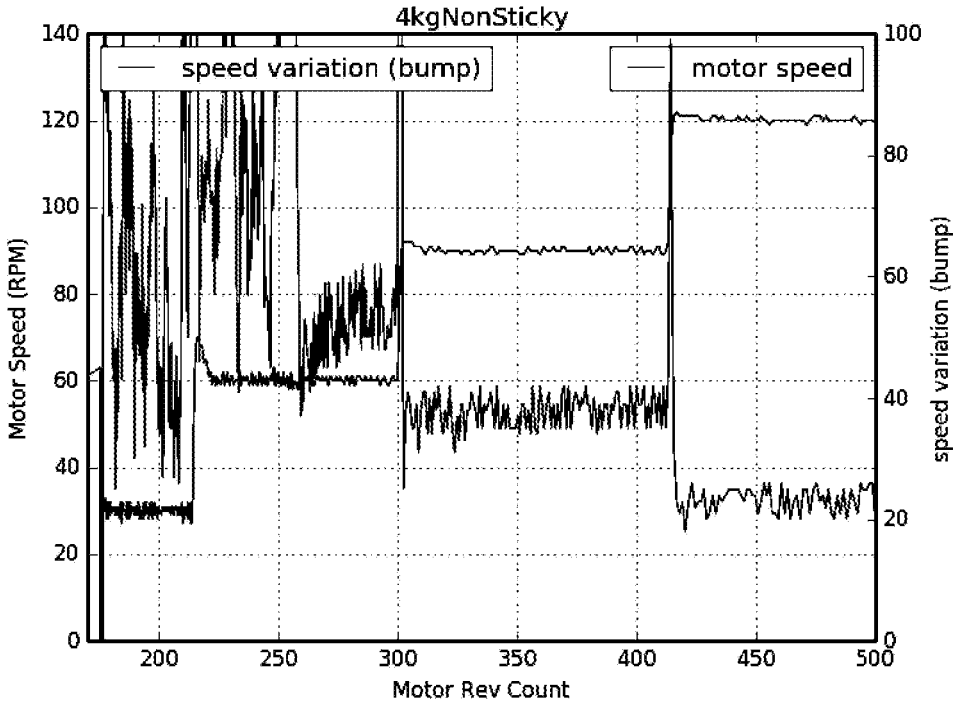
Figure 11:
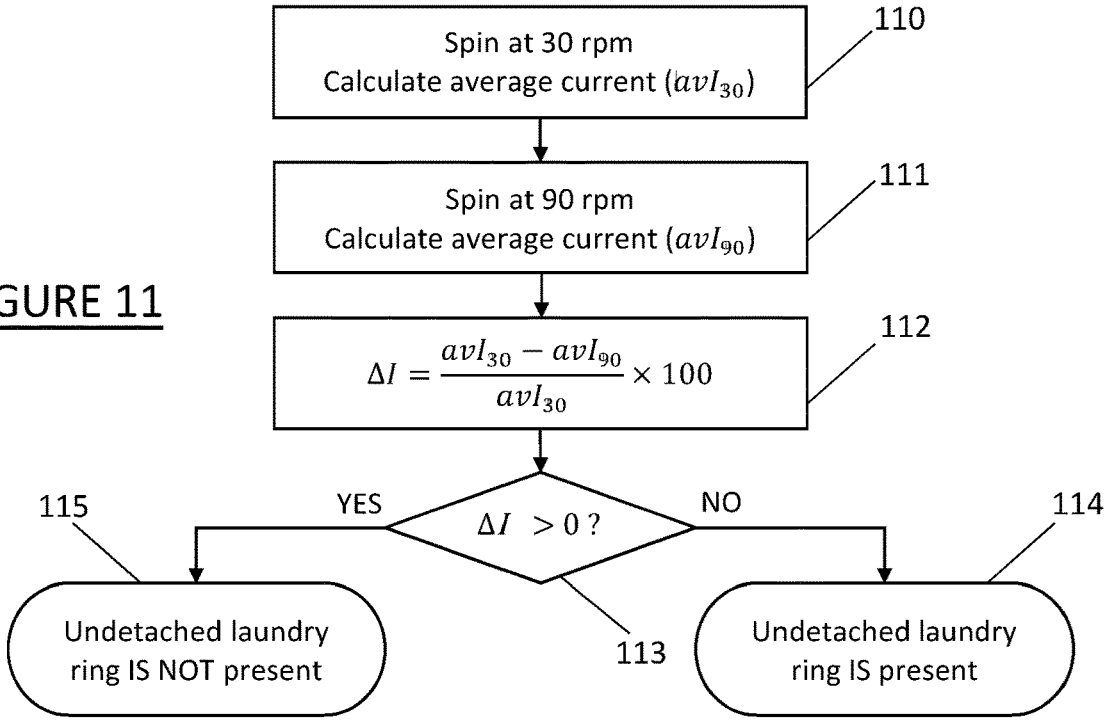
Figure 12:
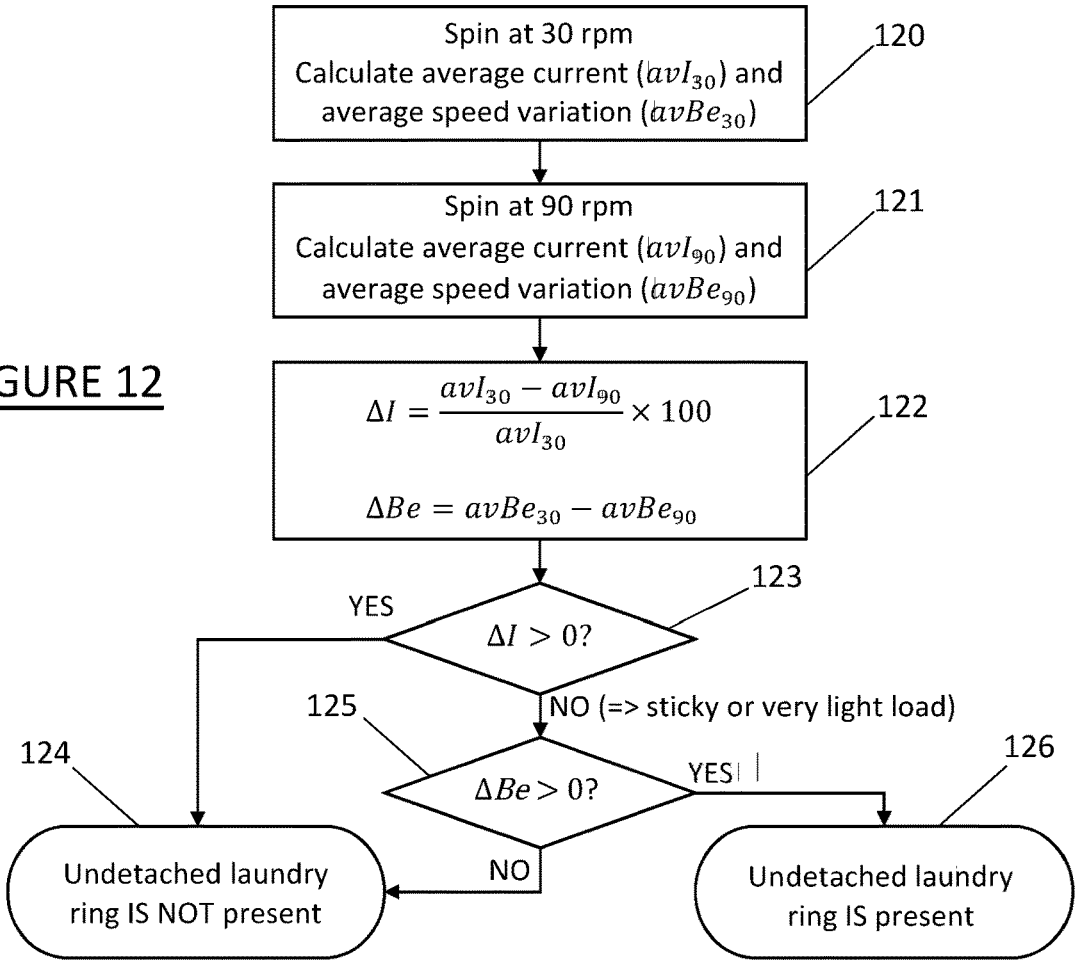
Figure 13:
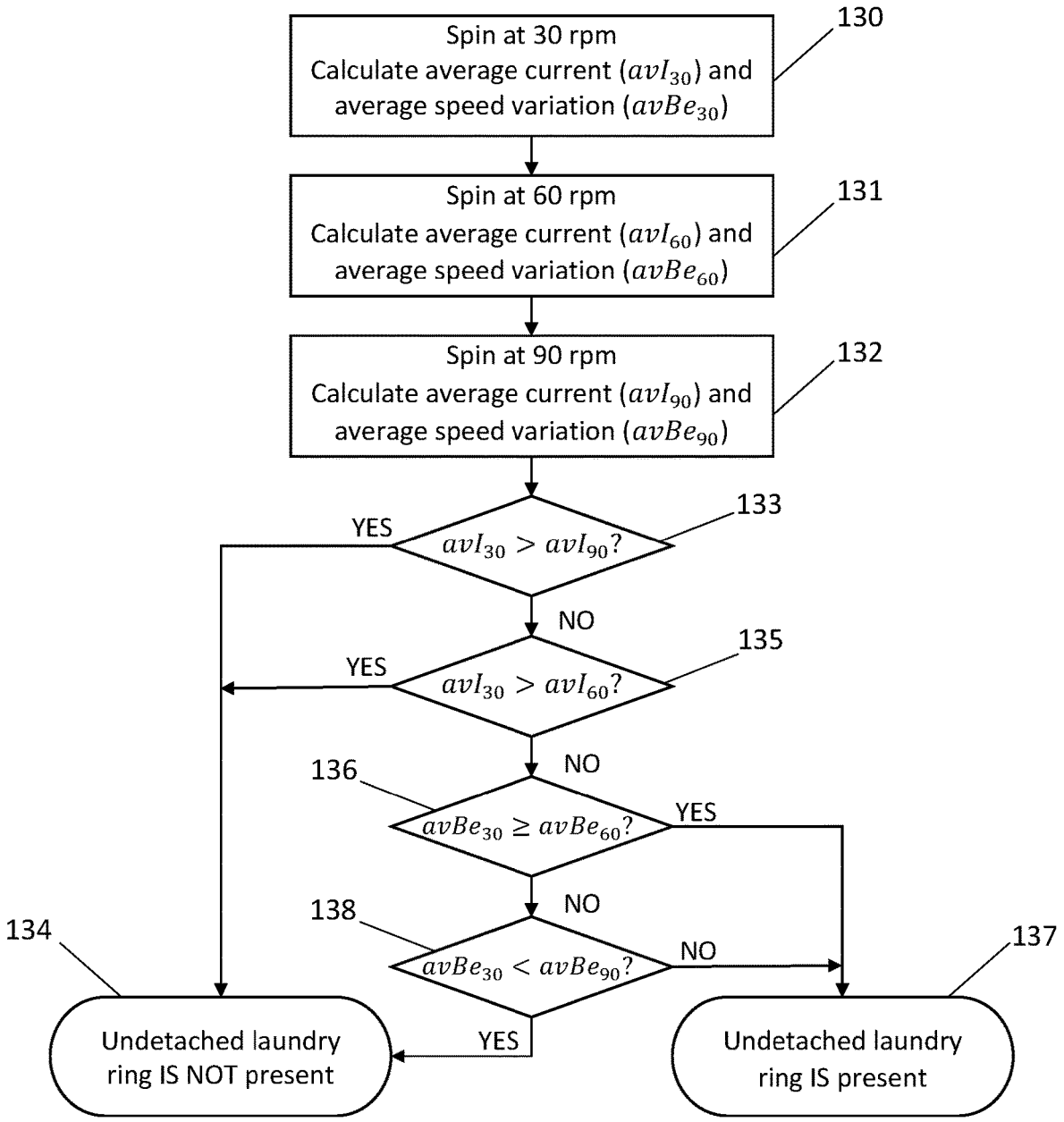

Preferred forms of the invention will now be described with reference to the accompanying drawings in which:

FIG. 1 is a perspective view of a front-loading laundry washing machine incorporating the laundry ring detection system according to a preferred embodiment of the present invention, FIG. 2 is a schematic front-elevational drawing of the laundry washing machine of FIG. 1, FIG. 3 is a graph showing motor speed and motor current versus motor revolutions count for a "non-sticky" (that is, not forming an undetached laundry ring) 4 kg laundry load of towels in the drum of the laundry washing machine of FIG. 1 following a washing cycle, FIG. 4 is a graph showing motor speed and motor current versus motor revolutions count for a 4 kg "sticky" (that is, forming an undetached laundry ring) laundry load of towels in the drum of the laundry washing machine of FIG. 1 following a washing cycle, FIG. 5 is a graph showing motor speed and motor current versus motor revolutions count for a 125 g "non-sticky" laundry load of towel material in the drum of the laundry washing machine of FIG. 1 following a washing cycle, FIG. 6 is a graph showing motor speed and motor speed variation versus motor revolutions count for a 330 g "non-sticky" laundry load of towel material in the drum of the laundry washing machine of FIG. 1 following a washing cycle, FIG. 7 is a graph showing motor speed and motor speed variation versus motor revolutions count for a 125 g "non-sticky" laundry load of towel material in the drum of the laundry washing machine of FIG. 1 following a washing cycle, FIG. 8 is a graph showing motor speed and motor speed variation versus motor revolutions count a 50 g "non-sticky" laundry load of towel material in the drum of the laundry washing machine of FIG. 1 following a washing cycle, FIG. 9 is a graph showing motor speed and motor speed variation versus motor revolutions count for a 50 g magnet adhered to the drum of the laundry washing machine of FIG. 1, simulating a 50 g "sticky" laundry load following a washing cycle, FIG. 10 is a graph showing motor speed and motor speed variation versus motor revolutions count for a 4 kg "non-sticky" laundry load of towels in the drum of the laundry washing machine of FIG. 1 following a washing cycle, FIG. 11 is a flow diagram illustrating a method of detecting the existence of an undetached laundry ring in the laundry washing machine of FIG. 1 in accordance with a first preferred embodiment of the present invention, FIG. 12 is a flow diagram illustrating a method of detecting the existence of an undetached laundry ring in the laundry washing machine of FIG. 1 in accordance with a second preferred embodiment of the present invention, and FIG. 13 is a flow diagram illustrating a method of detecting the existence of an undetached laundry ring in the laundry washing machine of FIG. 1 in accordance with a third preferred embodiment of the present invention.

A laundry clothes washing machine 1 such as that shown in FIGS. 1 and 2, as is well known, includes an outer cabinet or "wrapper" 2 mounted within which, by a suitable suspension system 3, is a generally cylindrical, fixed (non-rotating) outer tub 4 for containing washing liquid. Within the outer tub 4 a generally cylindrical, rotatable perforated drum 5 is mounted for holding a load of laundry, such as clothing, for washing. Although not shown in the drawings, the inner surface of the drum is ordinarily provided with plural generally-axially extending vanes spaced circumferentially about the drum and protruding radially inwardly from the drum's inner surface. The vanes are provided to assist in lifting and tumbling the laundry items in the laundry load within the drum 5. Access to the drum for loading and unloading the drum 5, in the case of a front-loading laundry machine, is via a door 6 mounted to cabinet 2. The outer tub may be formed from a plastics material and, in the case of a front-loading laundry washing machine as shown, the outer tub may be formed in two axially separate halves which are subsequently sealed together about the drum.

During operation of machine 1, a controller 8 receives input from a user interface such as control panel 9 or, although not shown, via a wirelessly-connected electronic device such as a "smart" mobile telephone or tablet device executing an applications program enabling the user to interact with controller 8. The user may, via interaction with the controller, be able to select certain wash cycles and to set certain wash parameters such as the level of soiling of the wash load, as is well-known. The user may also provide an indication of the size (such as the mass/weight) of the laundry load or, alternatively, the machine may incorporate a known automatic load-sensing function. For example, the load may be rotated at one or more rotational speeds and motor parameters such as required torque may be measured and used to estimate the size of the laundry load. In another example, one or more load sensor could be incorporated into the machine design, between cabinet 2 and water container 4, providing laundry load size (weight/mass) information to controller 8.

During a washing cycle water is provided to the drum via an inlet valve 7, under instruction of controller 8, usually via a "detergent" drawer 10 to allow a user to add detergent or other wash additives that are flushed out of the drawer and in to water container 4 in the known way. The controller may incorporate a microprocessor and associated memory for storing executable instructions in the form of a computer programme. At the end of the washing cycle (and optionally, at a predetermined stage or stages during the washing cycle) wash liquid exits the machine via outlet 11 when drain pump 12 is operated, again under instruction of controller 8. Although not shown in FIG. 2, a recirculation path for washing liquid may be provided from the drain pump back into water container 4 with a suitable valve provided to enable selection of recirculating or draining as instructed by controller 8.

Controller 8 is also connected to control the operation of an electric motor, for example a Brushless DC ("BLDC") Permanent Magnet motor having a rotor 13 and stator 14. Although FIG. 2 schematically illustrates the motor as an "inside-out" variety with a permanent magnet ring of the rotor radially outside outwardly radially-extending poles of the stator, it could instead have an internal permanent magnet rotor and radially inwardly-directed stator poles. Rotor 13 may be directly attached to or mounted on a shaft 15 fixed to drum 5 on the drum's rotational axis so that the rotor fixedly rotates with the drum. In this case it is usual for the stator to be mounted to the outer side of a base or end wall of the water container 4, opposite to door 6, with shaft 15 (and attached rotor 13) supported by at least one (usually at least two) roller bearing in the base. The electric motor could alternatively be mounted within cabinet 2 away from shaft 15 with a belt or chain rotationally connecting the motor's shaft and drum shaft 15.

Often, a sensor may be provided to detect the rotational speed of the rotor or drum and supply a signal indicative of the speed to controller 8. The sensor may, for example, output a voltage pulse for every rotation of the shaft/rotor/drum. This could be achieved by a rotor position sensor such as a Hall-effect sensor fixed to a non-rotating part of the machine, sensing the presence of a magnet mounted to a rotating part of the machine. However, a separate physical sensor may not be necessary and, instead, electronic feedback from the motor itself may act as a sensor and provide sufficient information to controller 8 to establish the position and/or speed of the rotor. For example, stator 14 has a plurality of radially-extending stator poles around which stator windings are wound, the windings for example comprising three separate phases connected in a star or delta configuration. In such a three-phase stator winding of a BLDC motor, controller 8 (or a separate but connected specialised motor controller) provides commutation voltage signals or patterns to switches that appropriately interconnect the various phases with appropriate supply voltages. Such commutation signals may energise only two of the three stator windings at any moment in time and the third, un-energised winding may be used as a back-EMF sensor to detect the rotational position (or change in rotational position) of the rotor and therefore the actual speed of the rotor by also measuring the time between back-EMF readings.

Controller 8 may, for example, operate the motor in a closed, speed control feedback loop whereby the controller establishes a commutation pattern to cause a desired rotor rotational speed and then detects the actual rotational speed that has been attained (via periodic position/speed feedback signals) and adjusts the commutation pattern accordingly for the next commutation of the stator windings so that the actual rotor speed approaches or is maintained at/around the desired rotational speed.

In accordance with preferred forms of the present invention, controller 8 is also programmed to carry out a series of steps (described below) aimed at determining whether drum 5 has an undetached laundry ring within it. An undetached laundry ring 16 is illustrated in FIG. 2 and most often occurs following a high-speed spin-drying phase of the washing cycle. This is usually at the end of the washing cycle, following phases of washing and rinsing the laundry load. Once the drum stops rotating at the end of the final high-speed spin-drying operation, if the laundry ring does not detach from the drum's surface under its own weight then an undetached laundry ring 16 is present. It should be noted that a laundry ring need not extend entirely around the drum's circumference and could instead simply be a partial ring or a discontinuous ring made of the various constituent laundry items of the load each adhered to another item of the laundry load or to a region of the drum's inner surface.

When machine 2 is a combined laundry washing and drying machine, it will of course also incorporate a drying circuit including a heat generating device (a heating element or a heat-pump) and a fan for circulating warm air through the drum for removing moisture from the laundry load. The heating circuit may be open to the external environment or it may be a closed loop such as is the case in a condensing clothes dryer or in a heat-pump clothes dryer. For a combined washer/dryer, detection of an undetached laundry ring 16 following completion of the washing cycle enables the laundry ring to be detached prior to commencement of the drying cycle, allowing the items within the laundry load to be more effectively dried by tumbling through the circulating heated air.

Accurately automatically determining whether an undetached laundry ring is present enables controller 8 to:

- reliably indicate to the user the presence of the ring and the need to manually detach it via a message on a display and/or via an audible alarm, and/or
- automatically energise the motor to carry out rapid acceleration/deceleration and/or rotational direction change actions to cause the laundry ring to detach from the drum.

In an automatic laundry ring detachment operation, valve 7 could also be opened to cause water to spray onto the laundry ring and/or to reach a level within water container 4 (with pump 12 and motor de-energised) that will wet a segment of the laundry ring. It has been found that partial wetting of the load may assist in detaching the laundry ring from the drum, although best water efficiency (and, in a combination washer/dryer, drying efficiency) will of course be attained without any additional water usage.

Undetached Laundry Ring Detection System

Preferred examples of a system for detecting the presence of an undetached laundry ring 16 in drum 5, following a spin-drying phase of a washing cycle) will now be described with reference to FIGS. 3 to 12.

In a first preferred embodiment, with reference in particular to FIGS. 3, 4 and 11, the machine 1 is provided with a sensor for providing controller 8 with an indication of the magnitude of the motor's output torque at any particular point in time; preferably a continuous or sampled torque (or torque-representative) signal. For example, a current sensor (such as a current-sensing resistor) may provide controller 8 with an input signal indicative of motor current, it being understood that motor current magnitude is proportional to output motor torque in an efficient motor topology such as a BLDC motor operated under a closed-loop speed control regime.

FIGS. 3 and 4 are explanatory waveforms of motor current (in mA) and actual motor speed (in rpm) versus motor revolution count for a 4 kg laundry load of towels at the completion of a washing cycle which terminated with a 1400 rpm spin-drying phase. The waveforms in FIG. 3 were obtained with a laundry load that had not formed an undetached laundry ring (that is, a "non-sticky" or freely tumbling load) while the waveforms of FIG. 4 were obtained from a laundry load that had formed an undetached laundry ring (that is, a "sticky" or non-tumbling load). Towels are known to be particularly vulnerable to the formation of an undetached laundry ring and a load size/weight of 4 kg is considered to be representative of a "normal" or average size/weight laundry load. Preferably, as explained above, rotor 13 of the motor is fixed to rotate with drum shaft 15 (such that there is no relative rotation therebetween) so that "motor speed", as well as being the rotor's rotational speed, is also the drum's rotational speed. In order to obtain the exemplary waveforms of FIGS. 3 and 4 it will be appreciated that controller 8 has energised the motor with appropriate commutation signals to:

ramp rotational speed up to 30 rpm,
hold rotational speed at 30 rpm for a period of time,
ramp rotational speed up to 60 rpm,
hold rotational speed at 60 rpm for a period of time,
ramp rotational speed up to 90 rpm,
hold rotational speed at 90 rpm for a period of time,
ramp rotational speed up to 120 rpm, and
hold the rotational speed at 120 rpm for a period of time.

The periods of time at which the rotational speed is held substantially constant (or at which the speed "plateaus") may be the same at each speed, although this is not reflected in the waveforms of FIGS. 3 and 4. The duration of each plateau or "hold" or threshold period may be estimated by dividing the number of motor revolutions in the plateau period by the rotational speed of the period. For example, in FIG. 3, the duration of the plateau period at 90 rpm may be calculated by:

$$T \cong \frac{113 \text{ revolutions}}{90 \text{ rpm}} \times 60 \cong 74.6 \text{ s}$$

For the case of a non-sticky laundry load (that is, an undetached laundry ring is not present) as shown in FIG. 3, the load tumbles inside drum 5 at the 30 rpm plateau rotational speed, starts to be distributed around the drum at the 60 rpm plateau rotational speed, and attaches to the inner surface of the drum (that is, is held against the drum's inner surface by centrifugal force) at speeds above 90 rpm. It is evident from FIG. 3 that the motor current at the plateau rotational speed of 30 rpm is significantly higher than the motor currents at each of the higher plateau rotational speeds. This is because:

At 30 rpm the motor needs a relatively large amount of torque (and therefore motor current) to counteract the weight of the items in the laundry load in order to lift them up from the bottom of the drum.

At 90 RPM, the centrifugal force on the laundry load is sufficiently large to lift the items of the laundry and distribute and hold them around the drum's inner surface. The laundry load then rotates together with the drum and acts to increase the inertia of the drum attached to the motor/drum shaft. When running at a constant rotational speed, the total inertia of drum and laundry load will keep the rotor rotating and only a relatively small amount of torque is required to overcome the frictional force opposing rotation of the rotor.

For the case of a sticky laundry load (that is, where an undetached laundry ring is present) as shown in FIG. 4, the laundry load will be distributed around the inner surface of the drum such that the drum is reasonably balanced (if it is not reasonably well balanced then most laundry washing machines would have stopped the washing process due to excessive out-of-balance and re-distributed the load). It is observed that:

The laundry load rotates together with the drum at all rotational speeds, and hence only a relatively small amount of motor torque (and therefore motor current) is required to counteract opposing friction forces at all speeds.

The amount of torque (and current) increases as the speed increases due to friction torque being roughly linearly proportional to the rotational speed when running at constant speed.

By comparing the torque (or current) at a first predetermined rotational speed (which is below a rotational speed that is capable of centrifugally holding the laundry load against the drum's inner surface) to that at a second predetermined rotational speed (which is at or above a rotational speed capable of centrifugally holding the laundry load against the drum's inner surface), it will be appreciated that in the non-sticky case (FIG. 3) there is a noticeable change in torque (or current). For example, in the non-sticky case, torque (or current) greatly reduces when changing from a first plateau rotational speed of 30 rpm to a second plateau rotational speed of 90 rpm. In the sticky case, the torque (or current) slightly increases when changing from a first plateau rotational speed of 30 rpm to a second plateau rotational speed of 90 rpm. Accordingly, by comparing the torque (or current) required at different plateau rotational speeds (for example, $I_{30}$ at 30 rpm and $I_{90}$ at 90 rpm) it is possible to differentiate whether an undetached laundry ring is present in the drum.

Based on these observations, FIG. 11 describes an exemplary method for deciding whether an undetached laundry ring is present in the drum in accordance with a first preferred embodiment of the invention, executed by controller 8. At block 110, the drum is set to spin at a first set plateau rotational speed of 30 rpm for a first predetermined period of time (for example, 10 seconds) and an indication of the motor current is determined during that period. Preferably the motor current is averaged during the 30 rpm plateau period to provide an average current value $avI_{30}$. At block 111 the drum's rotational speed is increased to a second set plateau rotational speed of 90 rpm and held there for a second predetermined period of time (for example, 10 seconds). Again, an indication of the motor current during the second plateau period is determined, such as an average current value $avI_{90}$. It is preferred, though not essential, that the first plateau rotational speed be lower than the second plateau rotational speed although it will be appreciated that the two speeds should simply be different and the higher speed could precede the lower speed. The specific values of 30 and 90 rpm have been selected because they have been found to enable a reliable and fast decision although other speeds, meeting the above requirements, could of course provide similar results.

Simply calculating the difference in average current values at the two predetermined plateau rotational speeds, and comparing that difference to a predetermined threshold value, may be sufficient to reliably decide whether an undetached laundry ring is present in the drum. However, it is preferred to calculate, at block 112, a value indicative of the percentage change in average current, going from the first predetermined speed to the second predetermined speed, and using that indicative value in a comparison with a threshold value. For example, block 112 calculates a percentage decrease value:

$$\Delta I = \frac{avI_{30} - avI_{90}}{avI_{30}} \times 100$$

A decision is made at decision block 113 as to whether an undetached laundry ring is present in the drum. If the laundry load has formed an undetached laundry ring in the drum, with a relatively balanced distribution, the percentage decrease in current should theoretically be negative (indicating an increase) or close to zero because as the rotational speed increases from 30 to 90 rpm, the current will increase slightly to overcome the opposing friction force, which increases linearly proportional to speed.

Accordingly, in this case $\Delta I<0$ (block 114) which indicates that an undetached laundry ring is present in the drum.

In contrast, if an undetached laundry ring is not present in the drum, the items of the laundry load will tumble at 30 rpm and they will be attached to the drum at 90 rpm, and the torque (or current) required at 30 rpm will be much greater than the torque (or current) required at 90 rpm.

Accordingly, in this case $\Delta I>0$ (block 115) which indicates that an undetached laundry ring is not present in the drum.

In the above decision a threshold percentage change in average current of 0 has been used. However, as demonstrated above, if an undetached laundry ring is not present in the drum then the value of $\Delta I$ will be much greater than zero while if an undetached laundry ring is present in the drum then the value of $\Delta I$ will be only slightly less than zero. A calculated percentage change value of zero may therefore be interpreted as indicating that an undetached laundry ring is present or, in order to provide some tolerance or safety margin, a small positive percentage value such as 10% or 20% could be selected as the threshold percentage decrease value. Of course, a percentage increase (rather than decrease) calculation could alternatively be used, with an appropriate threshold value to enable the undetached laundry ring presence decision to be reliably made. Or, as mentioned above, simply determining that the average current decreases from 30 rpm to 90 rpm could be sufficient to decide that an undetached laundry ring is not present in the drum and any other change in average current could imply that an undetached laundry ring is present in the drum.

As an example, applying the equation in block 112 to the graphs of FIGS. 3 and 4, and estimating the average current values from the graphs, correctly results in:

$$\Delta I_{Fig.3} = \frac{305\text{ mA} - 87\text{ mA}}{305\text{ mA}} \times 100 \cong 71\%$$

-continued $$\Delta I_{Fig.3} > 0 \Rightarrow \text{ring IS NOT present}$$

$$\Delta I_{Fig.4} = \frac{75\text{ mA} - 87\text{ mA}}{75\text{ mA}} \times 100 \cong -16\%$$

$$\Delta I_{Fig.4} < 0 \Rightarrow \text{ring IS present}$$

The algorithm presented above and illustrated in FIG. 11 has been found to reliably detect whether or not an undetached laundry ring is present when the load size is at least of an average size or weight. However, using the above algorithm based solely on motor current may not reliably detect the presence of an undetached laundry ring for very small/light laundry load sizes/masses. This is because, for very small loads (below, for example, about 330 g), for a non-sticky load the additional torque required to lift the load at 30 rpm (compared to 90 rpm when the load adheres to the drum) is negligible, so that irrespective of whether an undetached laundry ring is present in the drum, it has been observed that $avI_{30}<avI_{90}$ for very light loads. This could cause the above algorithm to incorrectly decide that an undetached laundry ring is present in the drum, particularly if the threshold level for the change in current (or percentage change in current) comparison is set to zero.

FIG. 5, for example, illustrates how motor current varies in response to the motor speed for a 125 g "non-sticky" laundry load. In FIG. 5 the magnitude of the average motor current at a rotational speed of 30 rpm is slightly less than the magnitude of the average current at a rotational speed of 90 rpm. We have also carried out tests for "non-sticky" laundry loads of 330 g and 50 g and confirmed that $avI_{30}>avI_{90}$ for the 330 g "non-sticky" load but for a 125 g non-sticky load $avI_{30}<avI_{90}$ (as in FIG. 5) so that with a threshold value of zero, the algorithm of FIG. 10 would incorrectly decide that a "sticky" load (i.e., an undetached laundry ring) is present in the drum for load sizes below about 330 g.

In order to more robustly detect undetached laundry rings in very small/light laundry loads, a second decision-making criterion could be added to the algorithm. Because, at low rotational speeds (below the speed at which the laundry is centrifugally held against the drum's surface), the laundry load within drum 5 is able to move (or tumble) relative to the drum, the load on shaft 15 is not constant. As a result, the actual magnitude of the rotor/drum speed, even once a desired or set rotational speed has been attained by controller 8, will fluctuate about that desired speed. The output signal from the rotor position/speed sensor (whether a motion-detecting separate physical sensor or a component/module of controller 8 that analyses electronic signals fed back from the stator) can enable controller 8 to monitor that speed fluctuation in order to detect whether tumbling of the load in the drum is occurring and therefore to help decide whether an undetached laundry ring is present in the drum. Accordingly, in a second preferred embodiment of the present invention (which will now be described with reference to FIGS. 6 to 10 and 12), in addition to the change in current used in the first embodiment, the amount of speed variation at various motor set speeds is also taken into consideration.

In the drawing figures this speed variation is referred to as the "Bump Energy" (Be) and is a measure of the total amount of speed variation during each complete motor mechanical revolution. Bump energy is a measure that has been used previously to detect off-balance (or out-of-balance) conditions in laundry washing machines (see, for example, US20070039106A). As an example, the value of Be for each revolution may in effect correspond to or represent an integration of the absolute value of the difference in magnitude between the actual rotational speed and the set rotational speed (or a moving average of the actual rotational speed), preferably at plural discrete sample times during each mechanical revolution. That is, at each sample point during the rotation, the absolute value of the difference between the actual speed and the set (or averaged actual) speed is determined and the differences summed over the full revolution to arrive at a value for Be for each revolution.

FIGS. 6 to 8 each show graphs of actual motor speed and speed variation (bump energy) versus motor revolution count for towel material laundry loads following a high-speed spin at the end of a washing cycle, where an undetached laundry ring is not present in the drum, and wherein the load sizes are 330 g, 125 g and 50 g, respectively. As in each of the preceding graphs, the actual motor speed signal is the waveform that steps upwardly relatively smoothly as motor revolution count increases, plateauing at rotational speeds of 30, 60, 90 and 120 rpm. The other waveform, which also generally follows a stepped pattern, but has a fluctuating value at each plateau or step, is speed variation (or bump energy). It is evident from FIGS. 6 to 8 that the speed variation measurement has a very obvious increase as the rotational speed rises from 30 rpm to 60 rpm. At 30 rpm, the laundry load items tumble inside the drum and the value of speed variation is relatively small. At a rotational speed of 60 rpm, the items of the laundry load are distributed around the drum's inner surface unevenly, due to the load size being so small that it cannot cover the entire circumference of the drum's inner surface. This uneven laundry load distribution causes the significant increase in the value of speed variation. However, increasing the rotational speed above 60 rpm causes the speed variation value to reduce as the effect that the uneven load has on the increasing angular momentum of the drum and laundry load reduces. As the rotational speed increases from 60 rpm to 120 rpm, the speed variation reduces gradually.

For a very small/light laundry load sizes/masses, where an undetached laundry ring is present in the drum, the trend in speed variation is opposite to that described immediately above, as shown for example in FIG. 9 for a 50 g laundry load adhered to the inner drum surface (simulated in this case by a 50 g magnet attached to the, ordinarily stainless steel, drum's inner surface). It is noted that in FIG. 9 the speed variation value reduces, for each step increase in rotational speed, from 30 rpm to 120 rpm. The different trend of speed variation value, depending upon whether an undetached laundry ring is present or not, as rotational speed changes, could therefore be utilised as a second criterion to assist in making the correct laundry ring detection decision. More preferably, comparing the speed variation values at 30 rpm and then 60 rpm, or 30 rpm and then 90 rpm, can detect, in a very light load:

- the presence of an undetached laundry ring, if the speed variation value decreases, or
- the absence of an undetached laundry ring, if the speed variation value increases.

Preferably, the speed variation criterion is determined at the same rotational speed plateaus as the motor current criterion. In that way, the first and second criterion can be detected/calculated during each of two rotational speed plateaus, minimising the time taken to carry out the method required to make the decision. Also, as with the first (motor current) criterion, preferably the speed variation signal is measured only during each plateau region of the speed signal, ideally being averaged so that a single speed variation value is generated for each rotor/drum speed plateau.

However, it has been found that this second criterion, using speed variation, is not particularly effective at differentiating whether an undetached laundry ring exists for larger or "normal" laundry load sizes/masses. This is because, particularly at low speeds (for example, 30 rpm but also at 60 rpm), the speed variation value signal from a "non-sticky" laundry load (no undetached laundry ring) fluctuates so much at each motor speed plateau that it is too "noisy" to be used in the detection algorithm. The reason for the large fluctuation in speed variation value is that as large laundry load items tumble at low speed they make a significant impact on the (low) rotational speed of the drum. As a result, it is preferred that the second (speed variation) criterion only be used to decide whether an undetached laundry ring is present for a light/small laundry load. While the following explanation of detection system using speed variation does not require input to the controller of the load size/mass, it could of course be provided and the algorithm adapted so that speed variation is only used as a distinguishing criterion when the load size/mass is below a predetermined threshold.

Based on the above observations, FIG. 12 describes an exemplary method for deciding whether an undetached laundry ring is present in the drum in accordance with a second preferred embodiment of the invention, executed by controller 8. At block 120, the drum is set to spin at a first plateau rotational speed of 30 rpm for a first predetermined period of time (for example, 10 seconds) and an indication of the motor current and of speed variation is determined during that period. Preferably the motor current and speed variation values detected during the 30 rpm plateau period are averaged to provide an average current value $avI_{30}$ and an average bump energy (speed variation) value $avBe_{30}$. At block 121 the drum's rotational speed is changed to set a second plateau rotational speed of 90 rpm for a second predetermined period of time (for example, 10 seconds). Again, indications of the motor current and speed variation during the second plateau period are determined, such as an average current value $avI_{90}$ and an average bump energy value $avBe_{90}$. It is preferred, though not essential, that the first plateau rotational speed be lower than the second plateau rotational speed and the specific values of 30 and 90 rpm have been selected because they have been found to enable a reliable and fast decision although other speeds, meeting the above requirements, could of course provide similar results.

As before, the difference in average current values at the two predetermined plateau rotational speeds could be used for comparison purposes but it is preferred to calculate, at block 122, a value indicative of the percentage change in average current $\Delta I$, going from the first predetermined speed to the second predetermined speed. Block 122 is similar to previous block 112 except an additional bump energy change value (change in speed variation value) $\Delta Be$ is also determined (in the preferred form shown in FIG. 12, a bump energy decrease value is calculated, so a negative value indicates an increase).

As in previous decision block 113, a decision is made at block 123 as to whether the calculated percentage change in motor current is greater than a threshold value (in the illustrated case, the threshold value is zero). If the percentage change in motor current is greater than the threshold value then it is decided (block 124) that an undetached laundry ring is not present in the drum. This is the situation illustrated in FIG. 3 where the load size is normal (or at least above about 200 g) and considerably more motor torque is required at 30 rpm to lift the items of the laundry load than at 90 rpm where the load is held against the drum's inner surface by centrifugal force.

If the change in current is not greater than zero at decision block 123, then either the load size is "normal" (greater than about 200 g) and an undetached laundry ring is present (i.e., a "sticky" load) or the laundry load is very light/small such that there was no change or a slight increase in motor current between 30 and 90 rpm. Control then passes to decision block 125 where the second criterion (speed variation) is introduced into the decision. At decision block 125, if there was a bump energy increase between 30 and 90 rpm (that is, $\Delta Be<0$) then control passes to block 124 where it is decided that an undetached laundry ring is not present in the drum. This situation is illustrated in FIGS. 7 and 8 where the "non-sticky" load size is very small but a significant increase in bump energy is detected when increasing the motor's rotational speed from 30 to 90 rpm. At decision block 125, if there was a bump energy reduction between 30 and 90 rpm (that is, $\Delta Be>0$) then control passes to block 126 where it is decided that an undetached laundry ring is present in the drum. This is the situation illustrated in FIG. 9 where, for a very light "sticky" load (but also for a "normal" or larger "sticky" load size), there is a reduction in bump energy when increasing motor rotational speed from 30 rpm to 90 rpm. Although the bump energy change is compared to a zero threshold in decision block 125, it could of course be compared to a different threshold value.

The exemplary waveforms of FIGS. 5 and 7 may be used to explain the operation of the algorithm of FIG. 12. Both of these drawing figures relate to a "non-sticky" (i.e., no undetached laundry ring is present), very light 125 g laundry load.

From FIG. 5 it is observed that:

$$avI_{30} \cong 77 \text{ mA and } avI_{90} \cong 91 \text{ mA}.$$

Substituting these values into the equation in decision block 123:

$$\Delta I = \frac{77 \text{ mA} - 91 \text{ mA}}{77 \text{ mA}} \times 100 \cong -18\%.$$

Because of this negative result, control passes from block 123 to decision block 125. From FIG. 7 it is observed that:

$$avBe_{30} \cong 7 \text{ and } avBe_{90} \cong 33.$$

Substituting these values into the equation in decision block 125:

$$\Delta Be = 7 - 33 = -26.$$

Because this result is also negative, it is correctly decided at block 124 that an undetached laundry ring is not present in the drum.

FIG. 13 describes an exemplary method for deciding whether an undetached laundry ring is present in the drum in accordance with a third preferred embodiment of the invention, executed by controller 8. This embodiment is similar to the second preferred embodiment although it involves measuring current and bump energy values at three separate substantially constant rotational plateau speeds. It should be noted that the motor current and/or bump energy values used in the comparisons exemplified in the present specification are not limited to being attained at only two or only three different threshold speeds and more than three speeds could be used.

In respective blocks 130, 131 and 132, motor current and speed variation values are obtained for exemplary rotational speeds of 30, 60 and 90 rpm and average current ($avI_{30}$, $avI_{60}$, $avI_{90}$) and speed variation ($avBe_{30}$, $avBe_{60}$, $avBe_{90}$) values are calculated for each. As previously mentioned, the plateau, substantially constant speeds may be maintained for around 10 seconds, for example.

A series of decision blocks (133, 135, 136, 139) then ensue which determine, from the average current (or torque) and speed variations at the three rotational speeds, whether an undetached laundry ring is present or not present in the drum. Firstly, decision block 133 compares average current at 30 rpm to average current at 90 rpm (percentage change in current could alternatively be calculated, as previously discussed). If average current at 30 rpm is greater than average current at 90 rpm then the load is of a "normal" size (greater than about 200 g) and it can be decided (block 134) that no undetached laundry ring is present in the drum.

If the answer to the decision in block 133 is "NO" then, at decision block 135 the average current at 30 rpm is compared to the average current at 60 rpm. Again, a percentage change in current could alternatively be calculated. If average current at 30 rpm is greater than average current at 60 rpm then the load size is very small (less than about 200 g) and it is decided (block 134) that no undetached laundry ring is present in the drum. This situation is illustrated in FIG. 5, for example, where there is a marginal increase in current as speed increases from 30 rpm (at which speed the load is tumbling) to 60 rpm (at which speed the load is no longer tumbling and current/torque need only overcome frictional forces of the machine rather than lifting the load).

If the answer to the question in decision block 135 is "NO" then, at decision block 136 the average speed variation at 30 rpm is compared to the average speed variation at 60 rpm. If the average speed variation at 30 rpm is greater than or equal to the average speed variation at 60 rpm then the load size is very small and it is decided (block 137) that an undetached laundry ring is present in the drum. This situation is illustrated in FIG. 9 where it will be appreciated that at 30 rpm the load is not tumbling but is instead simply an out of balance load on the drum surface, thereby generating a larger bump energy value than the equivalent tumbling load (FIG. 8) which has a smaller effect on the speed variation of the motor.

If the answer to the question in decision block 136 is "NO" then, at decision block 138 average speed variation at 30 rpm is compared to average speed variation at 90 rpm. If the average speed variation at 30 rpm is less than the average speed variation at 90 rpm then the load size is very small (less than about 200 g) and it is decided (block 134) that no undetached laundry ring exists in the drum. This situation is illustrated in FIGS. 7 and 8. It will be noted that some such loads will have been detected at decision block 135 although in some situations, motor current at 30 rpm may be the same as or slightly less than motor current at 60 rpm and the fact that no undetached laundry ring is present in the drum will only be confirmed by decision block 138.

If the answer to the question in decision block 138 is "NO" then it is decided (at block 137), by a process of elimination, that an undetached laundry ring is present in the drum. This is akin to the situation illustrated in FIG. 9 where, for a very light "sticky" load (but also for a "normal" or larger "sticky" load size), there is a reduction in bump energy when increasing motor rotational speed from 30 rpm to 90 rpm. Although the respective bump energy changes in decision blocks 136 and 138 are compared directly, a change in bump energy value could alternatively be determined (or a percentage change in bump energy value) and the resulting change value compared to a threshold value.

As discussed previously, once it has been decided that an undetached laundry ring is present in the drum (block 114 or 126), controller 8 may be further programmed to alert a user to the presence of the laundry ring, audibly and/or visually, such as via the control panel 9 of the appliance or on a wirelessly-connected device such as a mobile telephone. Controller 8 may alternatively or additionally be programmed to automatically loosen/detach/break/destroy the undetached laundry ring by undergoing a short additional detachment operation phase at the end of the washing cycle (or prior to the beginning of the drying cycle in a combined laundry washer/dryer) which involves rapidly changing speed and/or rotational direction of the drum until the laundry ring is broken, similar to the process described in the aforementioned DE19947307C. The detachment phase could alternatively or additionally include the introduction of water to the load, similar to the processes described in the aforementioned U.S. Pat. No. 2,990,706A and DE2416518A.

The invention claimed is:

1. A laundry washing or washing and drying machine comprising:

a cabinet, a water container mounted within the cabinet, a drum supported within the water container and rotatable relative thereto, the drum adapted to hold a laundry load, an electric motor having a rotor connected for rotating the drum when energised to do so, a current sensor to provide an indication of the motor current, and a controller operable to energise the rotor to rotate the drum at selected rotational speeds and to receive the motor current indication from the current sensor, the controller configured to:

energise the motor to rotate the drum at a first rotational speed, determine the magnitude of the motor current indication at the first rotational speed, energise the motor to rotate the drum at a second rotational speed, different to the first rotational speed, determine the magnitude of the motor current indication at the second rotational speed, and decide whether undetached laundry is present on the drum by comparing the motor current magnitude indication at the first rotational speed to the motor current magnitude indication at the second rotational speed.

2. The laundry washing or washing and drying machine according to claim 1, wherein the second rotational speed is greater than the first rotational speed, and wherein the controller is further configured to decide that undetached laundry is not present on the drum if the motor current magnitude indication at the first rotational speed is greater than the motor current magnitude indication at the second rotational speed, or the controller is further configured to decide that undetached laundry is present on the drum if the motor current magnitude indication at the first rotational speed is less than the motor current magnitude indication at the second rotational speed.

3. The laundry washing or washing and drying machine according to claim 1, wherein the second rotational speed is greater than the first rotational speed, the controller further configured to:

calculate a value indicative of a percentage change in motor current magnitude between the first and second rotational speeds, and decide that undetached laundry is not present on the drum if the calculated value indicates a percentage change in motor current magnitude from the first rotational speed to the second rotational speed which is greater than a predetermined percentage value, or decide that undetached laundry is present on the drum if the calculated value indicates a percentage change in motor current magnitude from the first rotational speed to the second rotational speed which is less than a predetermined percentage value.

4. The laundry washing or washing and drying machine according to claim 1, the controller further configured to energise the motor to rotate the drum at the first or second rotational speed for a predetermined period of time and the motor current magnitude indication for a particular rotational speed is determined by averaging a plurality of detected motor current magnitude indication values at that particular rotational speed during the predetermined period of time.

5. The laundry washing or washing and drying machine according to claim 1, wherein the controller is configured to set the first rotational speed below the speed required to centrifugally hold the laundry load against the surface of the drum for a complete drum rotation and to set the second rotational speed sufficiently high to hold the laundry load against the surface of the drum for a complete drum rotation.

6. The laundry washing or washing and drying machine according to claim 1, further comprising a speed detector for determining the rotational speed of the rotor or drum, wherein the controller is further configured to:

determine a first value indicative of the variation in speed of the motor or drum while the motor is energised to rotate the drum at a predetermined rotational speed, determine a second value indicative of the variation in speed of the motor or drum while the motor is energised to rotate the drum at a further predetermined rotational speed, different to the predetermined rotational speed, and decide whether undetached laundry is present on the drum by comparing the motor current magnitude indication at the first rotational speed to the motor current magnitude indication at the second rotational speed, and by comparing the first value to the second value.

7. The laundry washing or washing and drying machine according to claim 6, wherein the further predetermined rotational speed is greater than the predetermined rotational speed, and the second rotational speed is greater than the first rotational speed, and wherein the controller is further configured to decide that undetached laundry is not present on the drum if the motor current magnitude indication at the first rotational speed is less than the motor current magnitude indication at the second rotational speed, and the first value is less than the second value, or the controller is further configured to decide that undetached laundry is present on the drum if the motor current magnitude indication at the first rotational speed is less than the motor current magnitude indication at the second rotational speed, and the first value is greater than the second value.

8. The laundry washing or washing and drying machine according to claim 6, wherein the controller is further configured to energise the motor to rotate the drum at the predetermined rotational speed or the further predetermined rotational speed for a predetermined period of time and each value indicative of a variation in speed for a particular rotational speed is determined by averaging a plurality of detected speed variation values at that particular rotational speed during the predetermined period of time.

9. The laundry washing or washing and drying machine according to claim 6, wherein the controller is further configured to set the first rotational speed equal to the predetermined rotational speed and to set the second rotational speed equal to the further predetermined rotational speed.

10. The laundry washing or washing and drying machine according to claim 2, wherein the controller is configured to set the first rotational speed below the speed required to centrifugally hold the laundry load against the surface of the drum for a complete drum rotation and to set the second rotational speed sufficiently high to hold the laundry load against the surface of the drum for a complete drum rotation.

11. The laundry washing or washing and drying machine according to claim 3, wherein the controller is configured to set the first rotational speed below the speed required to centrifugally hold the laundry load against the surface of the drum for a complete drum rotation and to set the second rotational speed sufficiently high to hold the laundry load against the surface of the drum for a complete drum rotation.

12. The laundry washing or washing and drying machine according to claim 4, wherein the controller is configured to set the first rotational speed below the speed required to centrifugally hold the laundry load against the surface of the drum for a complete drum rotation and to set the second rotational speed sufficiently high to hold the laundry load against the surface of the drum for a complete drum rotation.

13. The laundry washing or washing and drying machine according to claim 2, further comprising a speed detector for determining the rotational speed of the rotor or drum, wherein the controller is further configured to:

determine a first value indicative of the variation in speed of the motor or drum while the motor is energised to rotate the drum at a predetermined rotational speed, determine a second value indicative of the variation in speed of the motor or drum while the motor is energised to rotate the drum at a further predetermined rotational speed, different to the predetermined rotational speed, and decide whether undetached laundry is present on the drum by comparing the motor current magnitude indication at the first rotational speed to the motor current magnitude indication at the second rotational speed, and by comparing the first value to the second value.

14. The laundry washing or washing and drying machine according to claim 3, further comprising a speed detector for determining the rotational speed of the rotor or drum, wherein the controller is further configured to:

determine a first value indicative of the variation in speed of the motor or drum while the motor is energised to rotate the drum at a predetermined rotational speed, determine a second value indicative of the variation in speed of the motor or drum while the motor is energised to rotate the drum at a further predetermined rotational speed, different to the predetermined rotational speed, and decide whether undetached laundry is present on the drum by comparing the motor current magnitude indication at the first rotational speed to the motor current magnitude indication at the second rotational speed, and by comparing the first value to the second value.

15. The laundry washing or washing and drying machine according to claim 4, further comprising a speed detector for determining the rotational speed of the rotor or drum, wherein the controller is further configured to:

determine a first value indicative of the variation in speed of the motor or drum while the motor is energised to rotate the drum at a predetermined rotational speed, determine a second value indicative of the variation in speed of the motor or drum while the motor is energised to rotate the drum at a further predetermined rotational speed, different to the predetermined rotational speed, and decide whether undetached laundry is present on the drum by comparing the motor current magnitude indication at the first rotational speed to the motor current magnitude indication at the second rotational speed, and by comparing the first value to the second value.

16. The laundry washing or washing and drying machine according to claim 5, further comprising a speed detector for determining the rotational speed of the rotor or drum, wherein the controller is further configured to:

determine a first value indicative of the variation in speed of the motor or drum while the motor is energised to rotate the drum at a predetermined rotational speed, determine a second value indicative of the variation in speed of the motor or drum while the motor is energised to rotate the drum at a further predetermined rotational speed, different to the predetermined rotational speed, and decide whether undetached laundry is present on the drum by comparing the motor current magnitude indication at the first rotational speed to the motor current magnitude indication at the second rotational speed, and by comparing the first value to the second value.

17. The laundry washing or washing and drying machine according to claim 7, wherein the controller is further configured to set the first rotational speed equal to the predetermined rotational speed and to set the second rotational speed equal to the further predetermined rotational speed.

18. The laundry washing or washing and drying machine according to claim 8, wherein the controller is further configured to set the first rotational speed equal to the predetermined rotational speed and to set the second rotational speed equal to the further predetermined rotational speed.

* * * * *